United States Patent [19]

Ostrander

[11] Patent Number: 4,815,561

[45] Date of Patent: Mar. 28, 1989

[54] ESCAPE DEVICE

[76] Inventor: Gary L. Ostrander, 441 Coronado Rd., Venice, Fla. 33595

[21] Appl. No.: 53,037

[22] Filed: May 22, 1987

[51] Int. Cl.[4] ..... E06C 9/10

[52] U.S. Cl. ..... 182/21; 182/77; 182/95; 182/163

[58] Field of Search ..... 182/20, 21, 24, 93, 182/95, 97, 81, 163, 218, 197, 198, 214, 76, 77, 156

[56] References Cited

U.S. PATENT DOCUMENTS

| | | | |
|---|---|---|---|
| 727,028 | 5/1903 | Thomas | 182/214 |
| 1,629,541 | 5/1927 | Scholer | 182/214 |
| 3,344,886 | 10/1967 | Boscarino, Jr. | 182/70 |
| 3,363,722 | 1/1968 | Rimi | 182/95 |
| 3,415,341 | 12/1968 | Hostetler | 182/198 |
| 3,444,958 | 5/1969 | McCall | 182/93 |
| 3,946,833 | 3/1976 | Riehlmann | 182/21 |
| 3,980,157 | 9/1976 | Wrigley | 182/95 |
| 4,235,306 | 11/1980 | Ross et al. | 182/189 |
| 4,445,589 | 5/1984 | Longenecker | 182/21 |
| 4,476,957 | 10/1984 | Ory | 182/21 |

FOREIGN PATENT DOCUMENTS

| | | | |
|---|---|---|---|
| 507177 | 6/1939 | United Kingdom | 182/77 |

*Primary Examiner*—Reinaldo P. Machado
*Attorney, Agent, or Firm*—Gifford, Groh, Sheridan, Sprinkle and Dolgorukov

[57] ABSTRACT

An escape device in accordance with the present invention includes an escape opening through the outside wall of a building at second and higher floor level, such opening being tall enough to allow a person to walk through it. A ladder, comprised of at least two sections, is pivoted to structure in the opening and is extendable to reach ground level outside the building. The ladder is stowed in the escape opening and ready for instant use in an emergency.

5 Claims, 2 Drawing Sheets

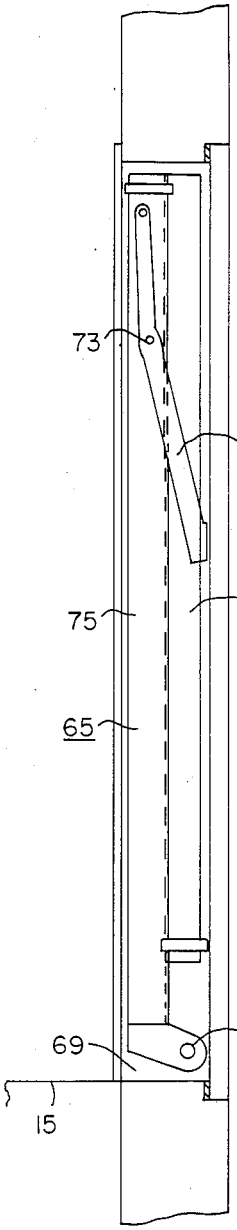
FIG.5
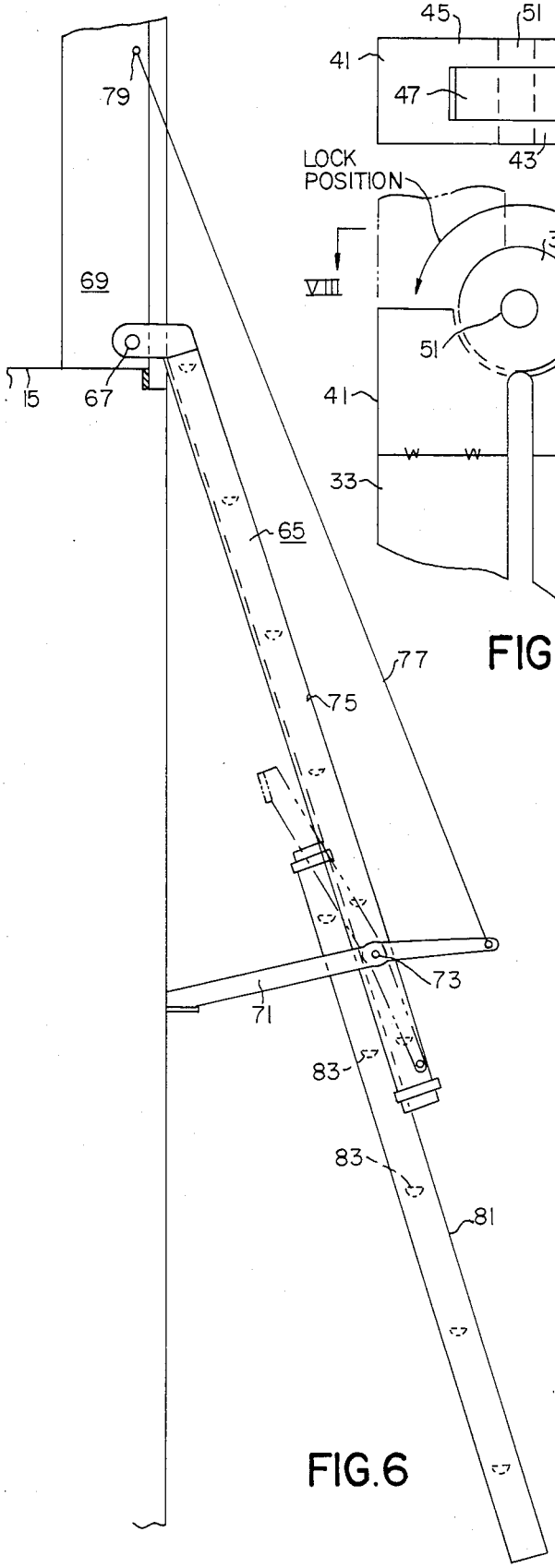
FIG.6
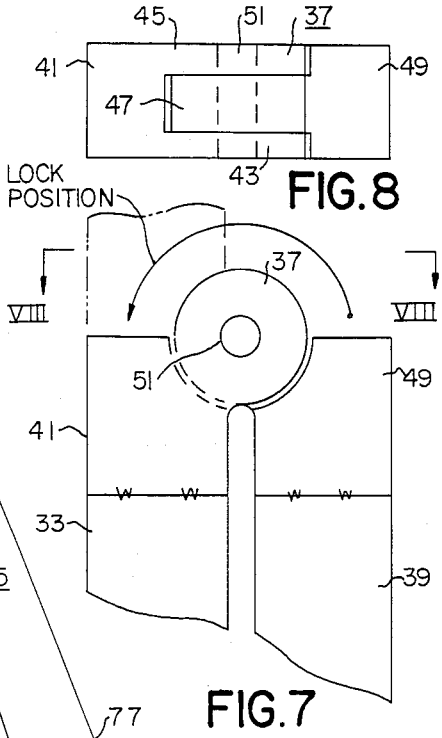
FIG.7
FIG.8

ESCAPE DEVICE

BACKGROUND OF THE INVENTION

1. Field

The present invention relates to safety devices and more particularly to an escape device to be utilized for escaping from elevated levels of buildings when an emergency, such as a fire, occurs in the building.

2. Prior Art

The prior art in this field of invention is somewhat limited to escape devices comprising rope ladders, chain ladders, and the like, that are permanently attached to the outside of a building or that are attachable to a window ledge and which, in time of an emergency, can be disposed outside of the building for evacuation or escape.

Representative of the prior art are U.S. Pat. Nos. 4,235,306 to Ross et al; 3,344,886 to Boscarino; 3,415,341 to Hostetler; and 3,444,958 to McCall.

U.S. Pat. No. 4,235,306 to Ross et al discloses an emergency escape apparatus comprising a cord or rope having along its length hand-held elements, together with a window mounting support.

U.S. Pat. No. 3,344,886 to Boscarino combines with a window flower box detachably mounted on a channel-shaped structure on the outside wall of a building such as a house, an extensible ladder, in collapsed condition, inside the flower box. One end of the ladder is connected to the channel-shaped structure and the other end is connected to the flower box.

U.S. Pat. No. 3,415,341 to Hostetler discloses a stackable ladder having metal steps connected to side ropes or chains. Each step has a shape that allows a person climbing down the ladder, when it is extended from a fixed anchor at a window, to grasp a step above the person thereby assisting the person in descending the ladder.

U.S. Pat. No. 3,444,958 to McCall discloses an extensible ladder comprised of a telescoping series of interconnected ladder parts adapted to be carried in a collapsed position on a base member mounted to the outside wall of a building, and to be enclosed within a removable cover member for immediate use in an emergency.

Most of the prior art escape devices assume that a person, in an emergency, can raise a window, manipulate the escape device, and then crawl out the window and descend the ladder or rope or whatever. Since most windows in buildings are double hung, there is no way for a person acting hurriedly in an emergency to open the entire window. Having only the lower half of the window open to afford access to the escape device does not provide enough room for a person to get out of the building and place himself in position to descend the escape device. If the person is carrying a small child or a baby, it is virtually impossible to use some of the prior art escape devices. The present invention makes it easy to use the ladder type of escape device of the present invention.

SUMMARY OF THE INVENTION

The present invention comprises a sectional ladder that is hinged at one end to supports inside of the wall of a building and that is extendable to ground or other support level. The sectional ladder is encased between the outside wall and the inside wall in an escape compartment, with removable or hinged closures on the inside and outside of the escape compartment.

An object of the present invention is to provide an escape opening through the wall of a building that allows a person to practically walk out of the building onto the sectional escape ladder previously lowered to ground level; the escape opening being closed inside and out with hinged or easily removable closures that may be decorative and unobtrusive.

The many other objects and advantages of the present invention will become apparent to those skilled in the art when the following description of the best modes contemplated at present for practicing the invention are read in conjunction with the accompanying drawings, wherein like reference numerals refer to like or equivalent parts.

BRIEF DESCRIPTION OF THE DRAWINGS

In the drawings:

FIG. 5 is a schematic view of a modified escape device in accordance with the invention showing it stowed in an escape opening in a building;

FIG. 6 is a schematic view showing the escape device of FIG. 5 in a fully extended position outside the building;

FIG. 7 is an enlarged view of the joint structure of the sectional escape device of the present invention; and FIG. 8 is a view along line VIII—VIII of FIG. 7.

DETAILED DESCRIPTION

Figures 1, 2, 3, 4:
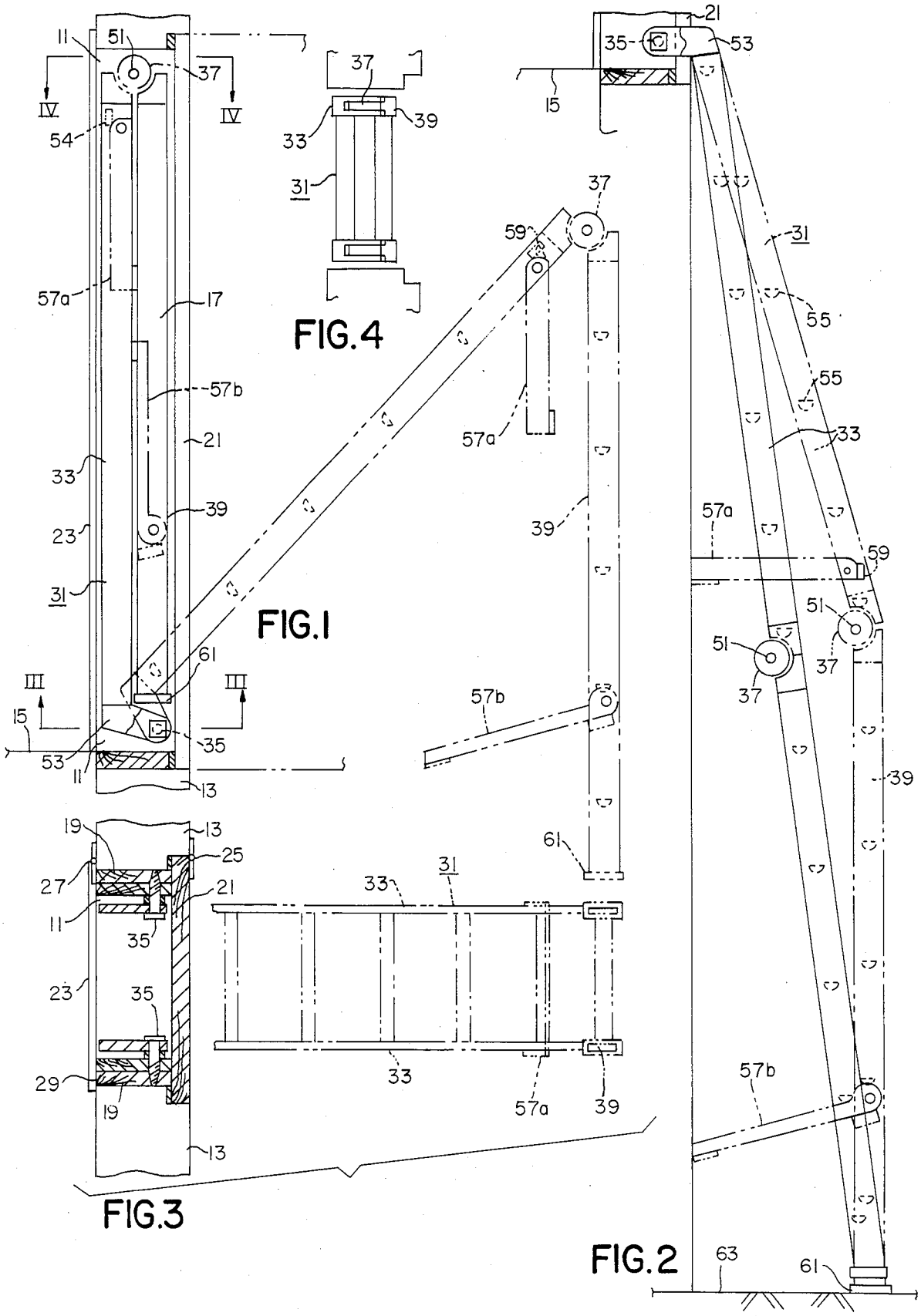
FIG. 1 is a schematic vertical sectional view of an escape opening through a wall of a building taken at a second floor level showing the escape device of the invention partially extended.
FIG. 2 is a schematic view of the escape device of the present invention in a fully extended position outside the building.
FIG. 3 is a view along line III—III of FIG. 1.
FIG. 4 is a view along line IV—IV of FIG. 1.

Referring to FIG. 1, an escape device in accordance with one embodiment of the present invention includes an escape opening 11 through the outer wall 13 of a building; such opening 11 extending vertically from floor level 15 to a predetermined height. There is, then, a wall compartment for storage of an escape device 17 that is pivotally connected to supports 19 (see FIG. 3) at the bottom of the opening 11.

The escape opening 11 through the wall 13 of the building is closed by an outside closure 21 that is flush with the surface of the outside wall, and by a similar inside closure 23, but which is not flush with the inside surface of the wall of the building. As shown in FIG. 3, the outside closure 21 is hinged as at 25, and the inside closure 23 is hinged as at 27. The outside and the inside closures 21,23 respectively are held in the closed position by means of magnets 29 in the wall 13 and a steel plate (not shown) on each closure 21,23. While each closure 21,23 is shown as being hinged, in a preferred embodiment of the invention, it is to be understood that each closure 21,23 may be secured in position by magnets and steel plates only without hinges.

Within the access openings 11 is the escape device 17 having the form of a sectional ladder 31 comprised of two sections. One section 33 is pivotally connected as at 35, on one end to the supports 19, and is hinged, as at 37, on the other end, to the other section 39.

The hinge 37 (FIGS. 7, 8) comprises a first cap 41 fitted to the free end of each side rail of the first ladder section 33; the cap 41 having a pair of knuckles 43,45 between which is loosely fitted a knuckle 47 of another cap 49 fitted to one end of each side rail of the second ladder section 39. A pintle 51 connects the several knuckles 43,45 and 47 together thereby forming the hinge 37.

Each side rail of the one section 33 of the ladder 31 has an offset arm 53 that is pivotally connected, as at 35, to the supports 17. As shown in FIG. 2, the sections 33,39 of the ladder 31 have a plurality of conventional rungs or steps 55.

In some instances, a pair of struts 57*a* are pivoted to the side rails of the one section 33 in such a way that, when the escape device 17 is extended, the struts 57*a* engage the outside wall 13 of the building, the struts 57*a* coacting with stops 59 located on the side rails about where shown in FIGS. 1 and 2.

Another pair of struts 57*b* are pivoted to the other ladder section 39 in such a way that when the escape device 17 is extended, the struts 57*b* engage the outside wall 13 of the building. The struts 57*b* coact on one end with a step of the ladder section 39 and they slope downwardly about as shown.

When the escape device 17 is stowed in the access opening 11 the struts 57*a*,57*b* depend downward as shown in FIG. 1, but when the escape device 17 is extended outward, the struts 57*a*,57*b* pivot to their working positions, as shown in FIG. 2.

Ordinarily, the ladder 31 does not have the pairs of struts 57*a*,57*b* and such ladder 31 extends downward in a straight sloping manner as shown in FIG. 2. The lower ends of the side rails of the ladder 31 have flat plate feet 61 that engage the ground 63 or other surface the ladder extends to when in use.

Referring to FIGS. 5 and 6, a modified form of escape device in accordance with the present invention includes a conventional extension ladder 65 that is pivotally mounted, as at 67, to supports within an escape opening 69, similar to the escape opening 11.

The ladder 65 is provided with a pair of arms 71 that are pivotally mounted, as at 73, to the one section 75 of the extension ladder 65. The arms 71 are connected at one end to cables 77 that are fixed to supports 79 on the inside walls of the escape opening 69; the other ends of the arms 71 engage the outside wall of the building to keep the extension ladder 65 away from the wall at a proper angle to enable persons using the ladder to descend. The other section 81 of the extension ladder 65 is extendable on the one section 75 and engages the ground or other surface adjacent the building.

A plurality of conventional rungs or steps 83 are connected between the side rails of the extension ladder 65.

Persons who are skilled in the art will recognize from the foregoing description of the invention many features and advantages among which the following are significant:

That the escape device is easily accessible for elderly persons and a person carrying a child and the device is easily put into operative position;

That the escape opening affords rapid access by persons that are about to use the escape device;

That the escape opening is closed both inside and outside the building with closures that may be decorative and are easily and quickly opened in an emergency; and That the escape ladders are easy to descend as in an ordinary ladder.

Although the invention has been described herein with a certain degree of particularity, it is understood that other modifications may be made therein without departing from the scope of the present invention as defined by the following claims.

What is claimed is:

1. An escape device installed in a building at an elevated level above ground comprising an escape opening at floor level through the outside wall of said building; a ladder comprised of sections that telescope together, pivoted at one end to supports in said escape opening, and extendable to said ground or other support surface adjacent said building; an arm pivotable on said ladder that is actuated by a cable anchored to said building, said arm, when pivoted, engaging the outside wall of said building; and means for closing the outside and inside wall openings.

2. The escape device of claim 1 wherein said escape opening through the outside wall allows a person to walk therethrough.

3. The escape device of claim 1 wherein the closure in the outside wall of said building lies flush with the surface thereof.

4. The escape device of claim 1 wherein the closure for the inside wall opening is pivotally mounted to said inside wall surface.

5. An escape device installed in a building at an elevated level above ground movable from a stored position to an extended position, said device comprising:

an escape opening at floor level through the outside wall of said building;

a ladder pivoted at one end to supports in said escape opening and extendable to said ground or other support surface adjacent said building;

means for closing the outside and inside wall opening;

said ladder comprising sections that are hinged together; and each of said sections of said ladder having struts pivotally and lockably attached thereto, said struts being gravitationally movable from a stored position to a bracing position when said device is in said extended position.

* * * * *